US006932034B2

(12) United States Patent
Machida et al.

(10) Patent No.: US 6,932,034 B2
(45) Date of Patent: Aug. 23, 2005

(54) FAIL-SAFE CONTROL APPARATUS FOR INTERNAL COMBUSTION ENGINE EQUIPPED WITH VARIABLE VALVE CHARACTERISTIC MECHANISM AND METHOD THEREOF

(75) Inventors: Kenichi Machida, Atsugi (JP); Hirokazu Shimizu, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/872,529

(22) Filed: Jun. 22, 2004

(65) Prior Publication Data

US 2004/0261738 A1 Dec. 30, 2004

(30) Foreign Application Priority Data

Jun. 24, 2003 (JP) ..... 2003-179478

(51) Int. Cl.[7] ..... F01L 1/34

(52) U.S. Cl. ..... 123/90.15; 123/90.17; 123/90.31; 123/90.16

(58) Field of Search ..... 123/90.15, 90.16, 123/90.17, 90.18, 90.27, 90.31, 345, 346, 347, 348

(56) References Cited

U.S. PATENT DOCUMENTS 5,549,080 A * 8/1996 Uchikawa ..... 123/90.16
5,715,779 A * 2/1998 Kato et al. ..... 123/90.15
6,834,627 B2 * 12/2004 Hiraku et al. ..... 123/90.15
6,877,466 B2 * 4/2005 Shindou et al. ..... 123/90.16

FOREIGN PATENT DOCUMENTS

JP 4-63922 A 2/1992

* cited by examiner

*Primary Examiner*—Thomas Denion
*Assistant Examiner*—Ching Chang
(74) *Attorney, Agent, or Firm*—Foley & Lardner LLP

(57) ABSTRACT

When it is detected that any one of a plurality of variable valve characteristic mechanisms disposed for every cylinder groups is failed, an effective opening degree (valve lift amount, valve operating angle or the like) in a valve characteristic in the failed state, is obtained. When the effective opening degree is judged to be a predetermined value or above, the valve characteristic of the normal variable valve characteristic mechanism is controlled to be coincident with the valve characteristic in the failed state. When the effective opening degree is judged to be less than the predetermined value, there is performed a control for limiting the control to coincide the valve characteristic of the normal variable valve characteristic mechanism with the valve characteristic in the failed state.

19 Claims, 10 Drawing Sheets

FAIL-SAFE CONTROL APPARATUS FOR INTERNAL COMBUSTION ENGINE EQUIPPED WITH VARIABLE VALVE CHARACTERISTIC MECHANISM AND METHOD THEREOF

FIELD OF THE INVENTION

The present invention relates to a technique in which, in an internal combustion engine equipped with variable valve characteristic mechanisms, each of which varies a valve characteristic relating to an effective opening degree of an engine valve (intake or exhaust valve), a fail-safe control is performed when the variable valve characteristic mechanism is failed.

RELATED ART OF THE INVENTION

Japanese Unexamined Patent Publication No. 4-63922 discloses a technique in which, in a V-type internal combustion engine equipped with a variable valve characteristic mechanism disposed for each cylinder group on each bank forming a V-shape, which comprises a low speed cam and a high speed cam, and switches a valve characteristic according to engine operations, when the variable valve characteristic mechanism of one of the cylinder groups is failed, the valve characteristic of the normal variable valve characteristic mechanism of the other cylinder group is controlled to be coincident with the valve characteristic of the failed variable valve characteristic mechanism, to prevent a torque variation.

The above described Publication also discloses that, in the case where the variable valve characteristic mechanism of one of the cylinder group is failed to be fixed to the high speed cam, the drop of torque at the low rotation time should be prevented, as a control according to a normal operation condition, without fixing the normal variable valve characteristic mechanism of the other cylinder group to the high speed cam.

However, in an internal combustion engine equipped with a variable valve characteristic mechanism capable of continuously varying a valve lift amount, which controls an intake air amount by means of an intake valve, namely adopts a non-throttle control, it is possible to control the lift amount at a minimal lift amount. Therefore, in the case of a failure in which the valve lift amount is fixed at the minimal lift amount, if a control is performed to coincide an intake valve amount on the normal side with the lift amount on the failed side, there is a possibility that the intake air amount becomes insufficient, the combustibility becomes unstable, the drivability is deteriorated, and in the worst case, the engine is stopped.

SUMMARY OF THE INVENTION

It is therefore an object of the present invention to, when any one of variable valve characteristic mechanisms is failed, control the other variable valve characteristic mechanism at an appropriate state, to ensure the excellent drivability as much as possible.

In order to accomplish the above described object, the present invention is constituted so that, when an occurrence of failure is detected in any one of a plurality of variable valve characteristic mechanisms disposed for each of cylinder groups, an effective opening degree in a valve characteristic in the failed state is obtained, and when it is judged that the effective opening degree is a predetermined value or above, a valve characteristic of the normal variable valve characteristic mechanism is controlled to be coincident with the valve characteristic in the failed state, and when it is judged that the effective opening degree is less than the predetermined value, there is performed a control for limiting the control to coincide the valve characteristic of the normal variable characteristic mechanism with the valve characteristic in the failed state.

The other objects and features of the invention will become understood from the following description with reference to the accompanying drawings.

DESCRIPTION OF THE PREFERRED EMBODIMENT

Figure 1:
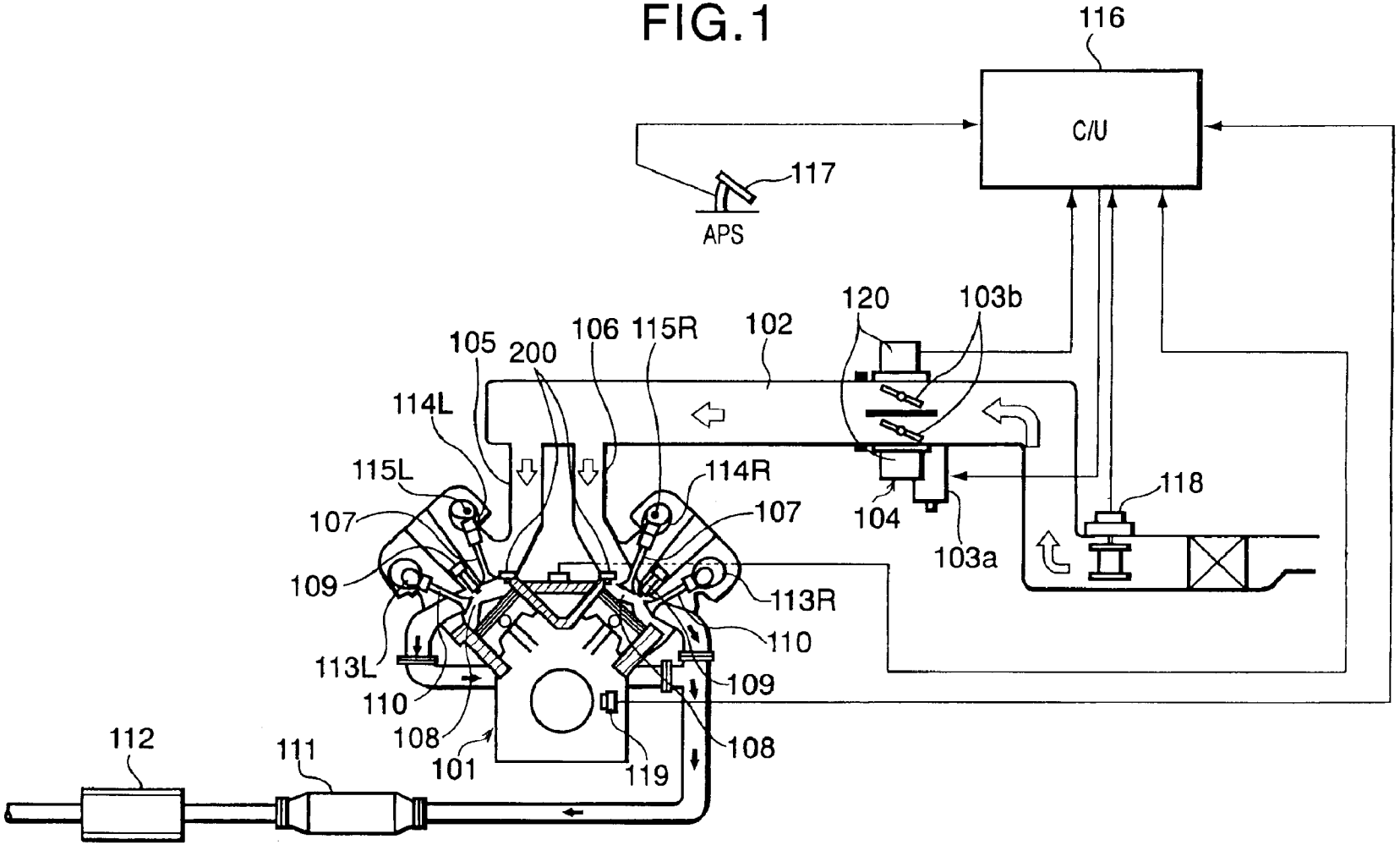
FIG. 1 is a diagram of a system structure of a fail-safe control apparatus for a V-type internal combustion engine equipped with variable valve characteristic mechanisms in an embodiment of the present invention.

In FIG. 1, in an intake pipe 102 on the upstream side of a V-type internal combustion engine 101 equipped with a fail-safe control apparatus according to the present invention, an electronically controlled throttle (ETC) 104 is disposed for driving throttle valves 103*b* to open and close by a throttle motor 103*a*.

Intake manifolds 105 and 106 branched from intake pipe 102, are respectively connected with cylinder groups on the left and right banks forming a V-shape. Then, air having passed through ETC 104 and intake manifolds 105 and 106 is sucked into each combustion chamber 108 via an intake valve 107 of each cylinder. An ignition plug 109 is mounted on each combustion chamber 108. Further, a fuel injection valve 200 is disposed for each cylinder.

A combusted exhaust gas is discharged from each combustion chamber 108 via each exhaust valve 110, and then, purified by a catalytic converter 111, thereafter, emitted into the atmosphere via a muffler 112.

Each exhaust valve 110 is driven by each of cams 113L and 113R axially supported by exhaust side camshafts of each bank, respectively, to open and close while maintaining a fixed valve lift amount and valve operating angle (crank angle of from opening timing to closing timing) thereof. A valve lift amount and an operating angle of each intake valve 107 are successively varied by each of variable valve event and lift (WEL) mechanisms 114L and 114R, being a variable valve characteristic mechanism for each bank. Here, the valve lift amount and the valve operating angle are valve characteristics relating to an effective opening degree, and therefore, are changed simultaneously so that, if one of the valve characteristics is determined, the other is also determined.

The operating angles of intake valves 107 of the left and right banks by WEL mechanisms 114L and 114R are detected by operating angle sensors 115L and 115R of potentiometer type, respectively, as described later.

A control unit 116 controls ETC 104, and WEL mechanisms 114L and 114R according to an accelerator opening detected by an accelerator pedal sensor APS 117, so that an intake air amount corresponding to the accelerator opening can be obtained depending on openings of throttle valves 103*b* and opening characteristics of intake valves 107. However, in a basic operating condition other than an operating condition where an intake negative pressure is required, throttle valves 103*b* are held fully opened, and the intake air amount is controlled by only WEL mechanisms 114L and 114R.

Control unit 116 incorporating therein a microcomputer, receives detection signals from an air flow meter 118 detecting an intake air amount (mass flow rate), a crank angle sensor 119 taking out a rotation signal from a crankshaft, a throttle sensor 120 detecting the openings of throttle valves 103*b* and the like, in addition to accelerator pedal sensor APS 117.

Figure 2:
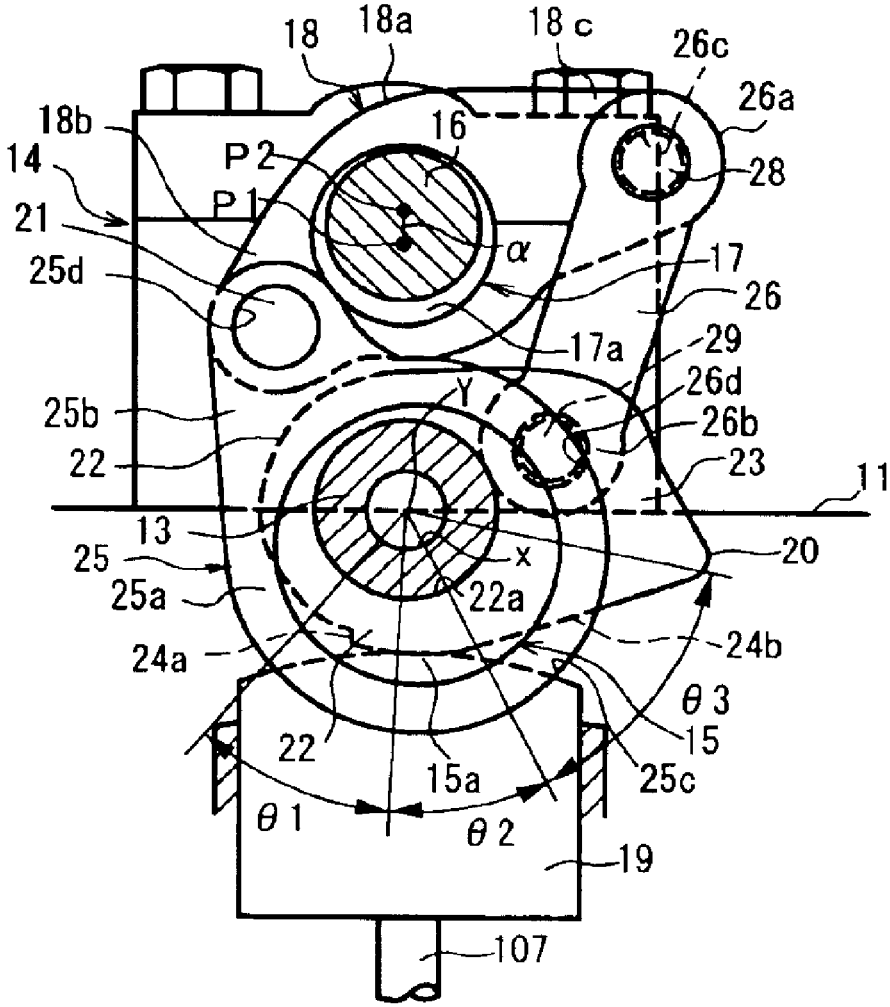
FIG. 2 is a cross section view showing the variable valve characteristic mechanism in the embodiment (A—A cross section of FIG. 3).
Figure 3:
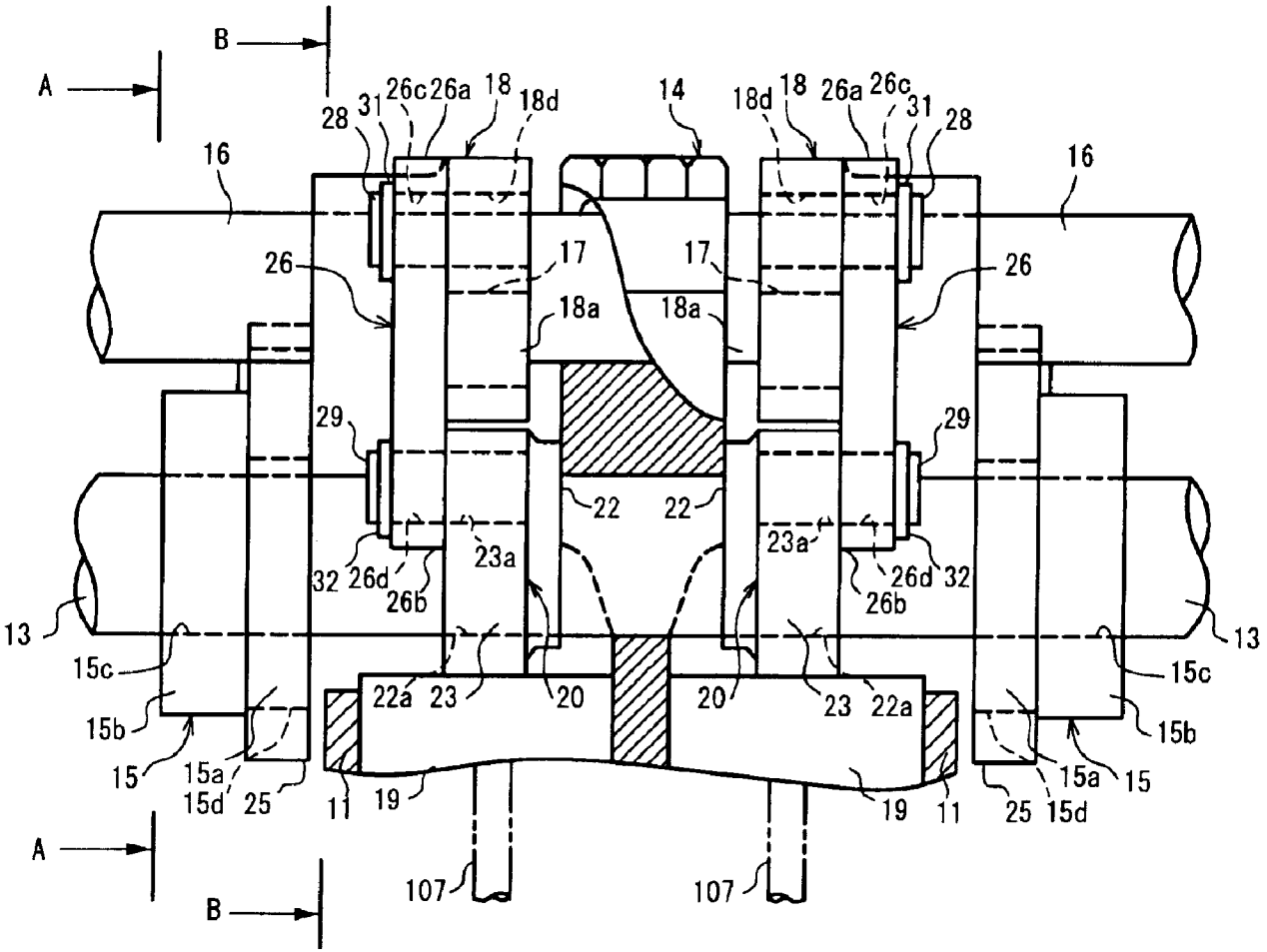
FIG. 3 is a side elevation view of the variable valve characteristic mechanism.
Figure 4:
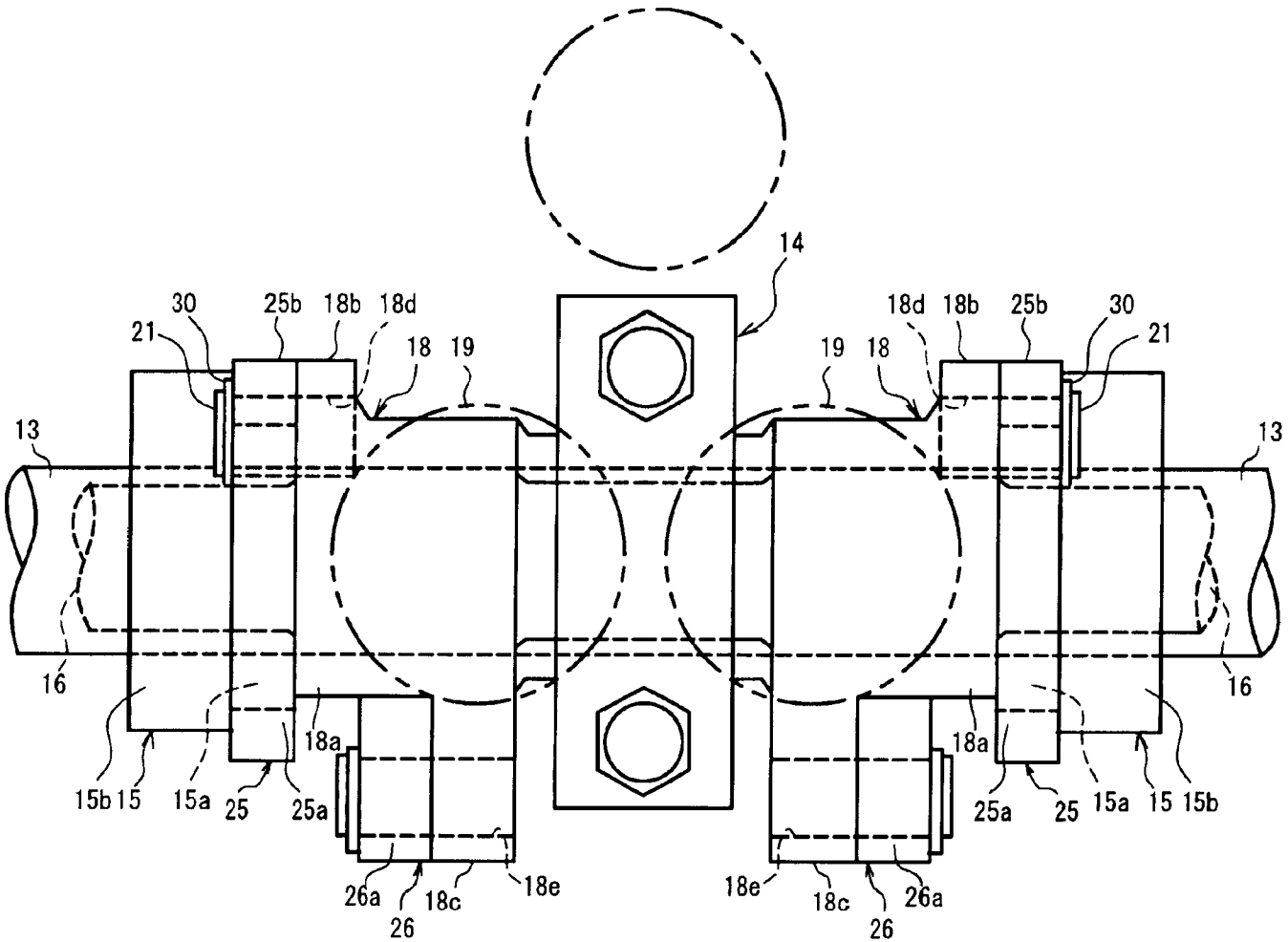
FIG. 4 is a top plan view of the variable valve characteristic mechanism.

FIG. 2 to FIG. 4 show in detail the structure of WEL mechanism 114.

The WEL mechanism shown in FIG. 2 to FIG. 4, includes a pair of intake valves 107, 107, a hollow camshaft 13 (drive shaft) rotatably supported by a cam bearing 14 of a cylinder head 11, two eccentric cams 15, 15 being rotation cams, axially supported by camshaft 13, a control shaft 16 rotatably supported by cam bearing 14 and arranged at an upper position of camshaft 13, a pair of rocker arms 18, 18 swingingly supported by control shaft 16 through a control cam 17, and a pair of swing cams 20, 20 disposed independently from each other to upper end portions of intake valves 107, 107 through valve lifters 19, 19, respectively.

Eccentric cams 15, 15 are connected with rocker arms 18, 18 by link arms 25, 25, respectively, and rocker arms 18, 18 are connected with swing cams 20, 20 by link members 26, 26.

Figure 5:
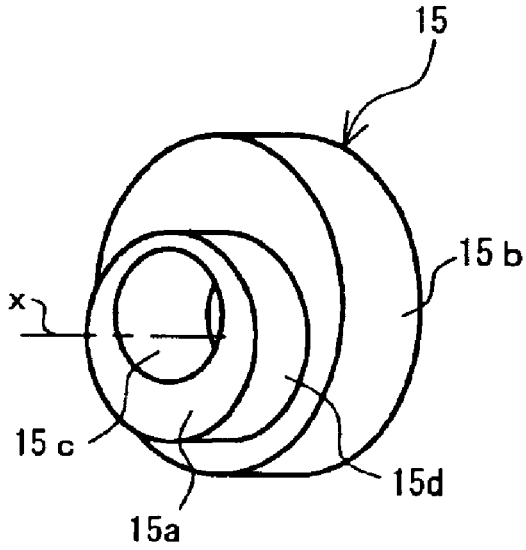
FIG. 5 is a perspective view showing an eccentric cam for use in the variable valve characteristic mechanism.

Each eccentric cam 15, as shown in FIG. 5, is formed in a substantially ring shape and includes a cam body 15*a* of small diameter, a flange portion 15*b* integrally formed on an outer surface of cam body 15*a*. A camshaft insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* at outsides of valve lifters 19, 19, respectively, so as not to interfere with valve lifters 19, 19, and also, outer surfaces 15*d* of cam bodies 15*a* thereof are formed in a predetermined cam profile.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*. A pin hole 18*e* is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to a periphery of control shaft 16. As shown in FIG. 2, a center axis P1 position of control cam 17 is biased from a center axis P2 position of control shaft 16 by $\alpha$.

Figure 6:
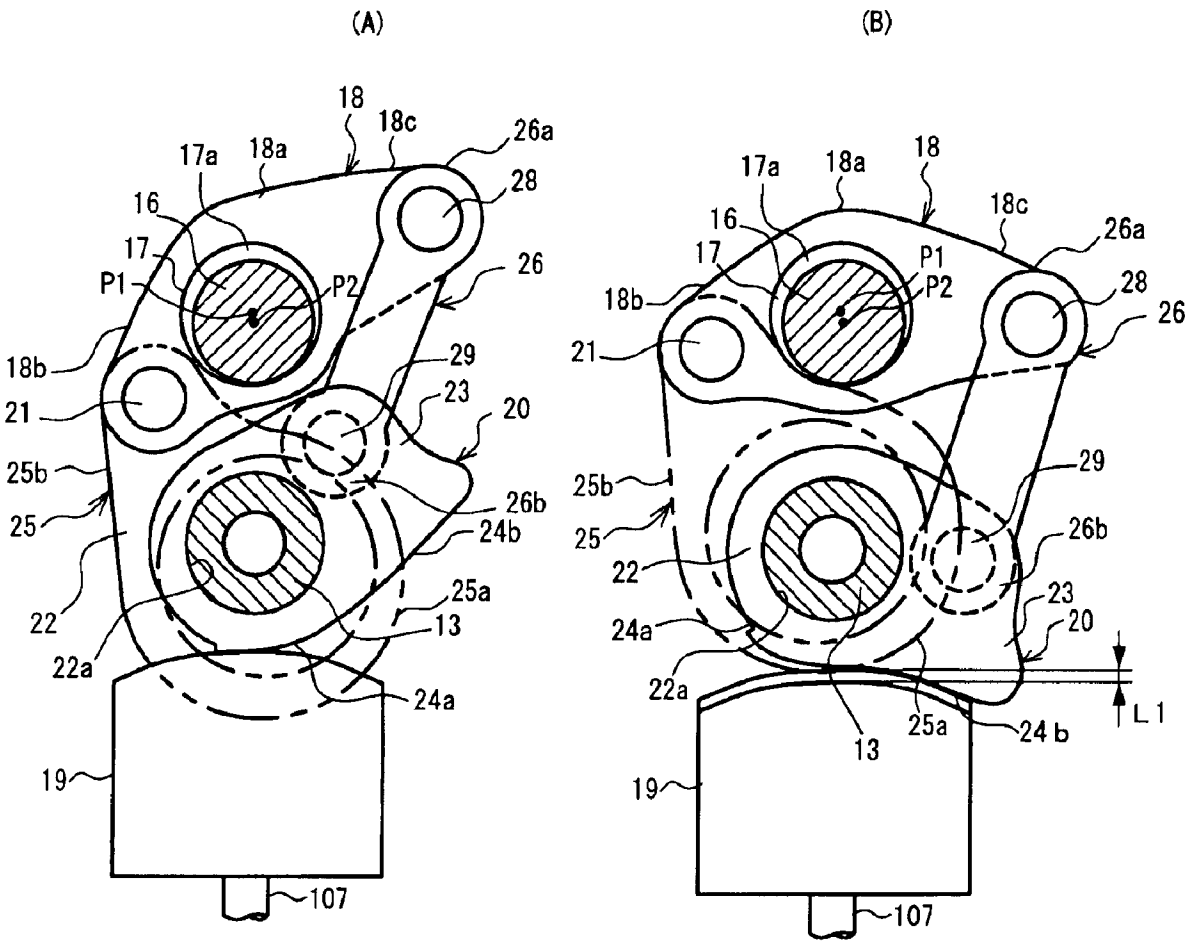
FIG. 6 is a cross section view showing an operation of the variable valve characteristic mechanism at a low lift condition (B—B cross section view of FIG. 3).
Figure 7:
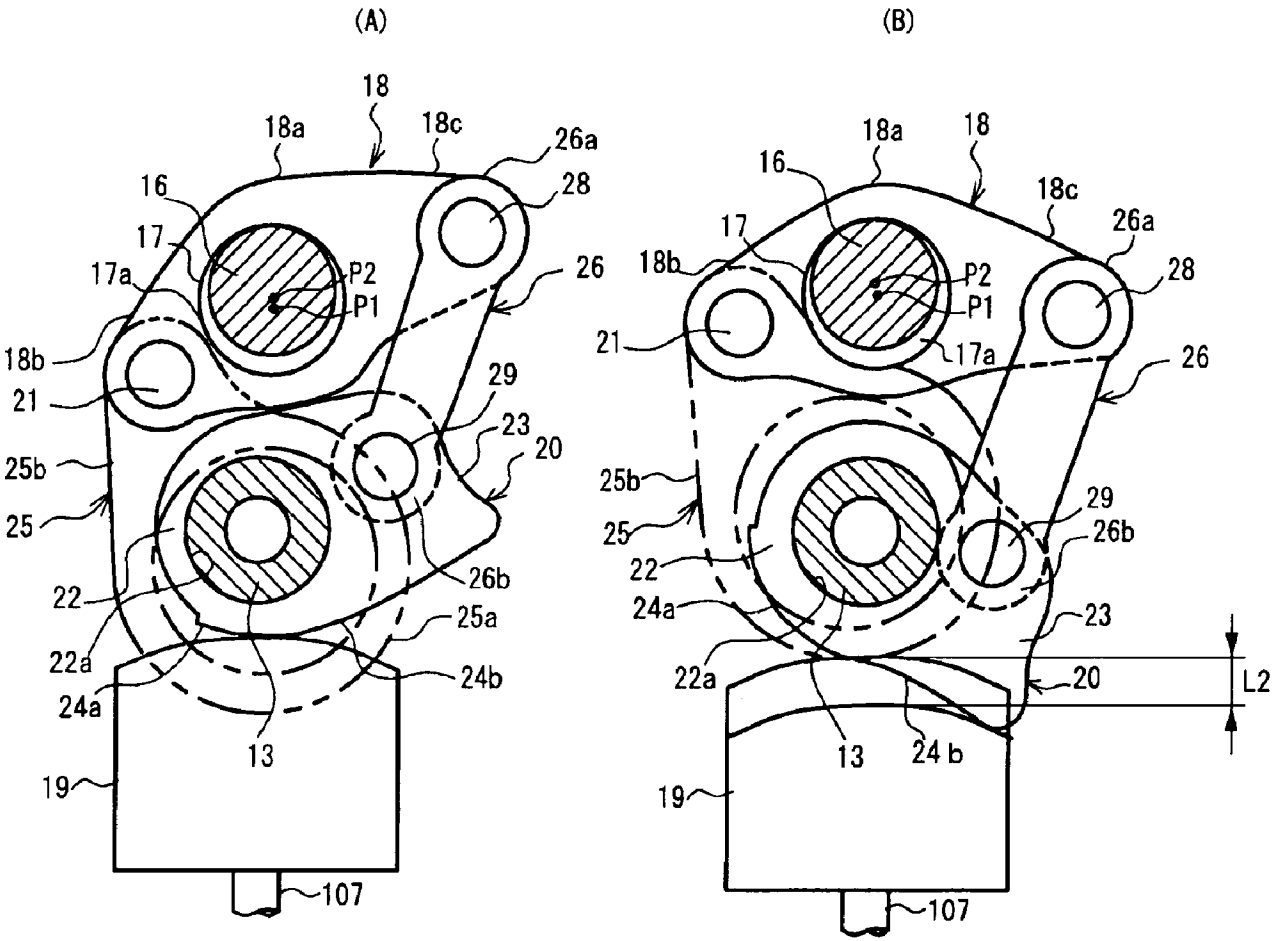
FIG. 7 is a cross section view showing an operation of the variable valve characteristic mechanism at a high lift condition (B—B cross section view of FIG. 3).

Swing cam 20 is formed in a substantially lateral U-shape as shown in FIG. 2, FIG. 6 and FIG. 7, and a supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18*c* of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Figure 8:
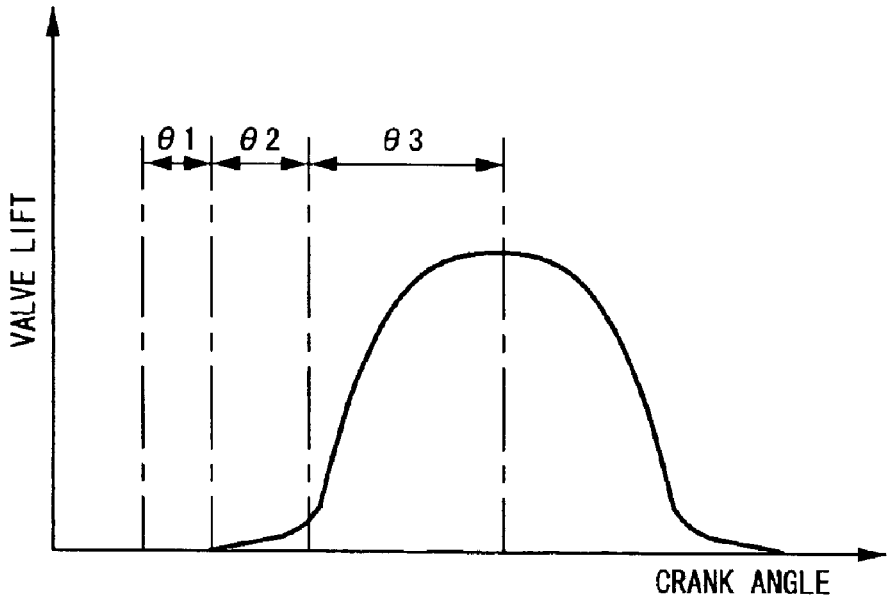
FIG. 8 is a valve lift characteristic diagram corresponding to a base end face and a cam face of a swing cam in the variable valve characteristic mechanism.

Namely, according to a valve lift characteristic shown in FIG. 8, as shown in FIG. 2, a predetermined angle range $\theta$1 of base circular surface 24*a* is a base circle interval and a range of from base circle interval $\theta$1 of cam surface 24*b* to a predetermined angle range $\theta$2 is a so-called ramp interval, and a range of from ramp interval $\theta$2 of cam surface 24*b* to a predetermined angle range $\theta$3 is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Note, link arm 25 and eccentric cams 15 constitute a swingingly driving member.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

In the above structure, the valve lift amount is varied according to a positional relation between the center axis P2 of control shaft 16 and the center axis P1 of control cam 17, as shown in FIG. 6 and FIG. 7. Control shaft 16 is driven to rotate, so that the position of center axis P2 of control shaft 16 relative to the center axis P1 of control cam 17 is changed.

Figure 9:
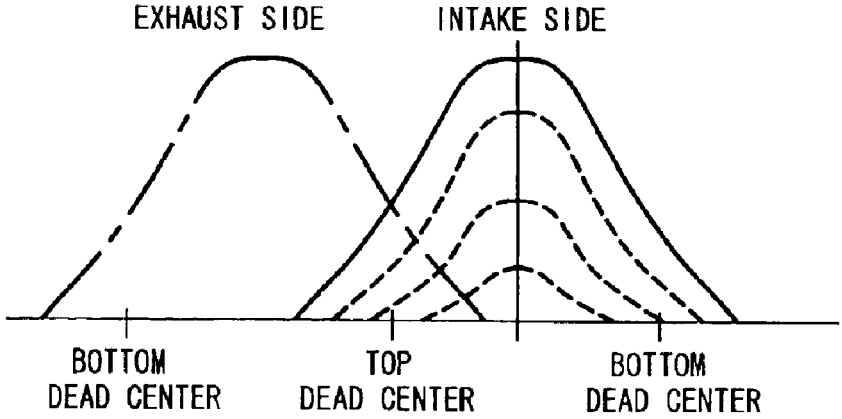
FIG. 9 is a characteristic diagram showing valve timing and a valve lift in the variable valve characteristic mechanism.
Figure 10:
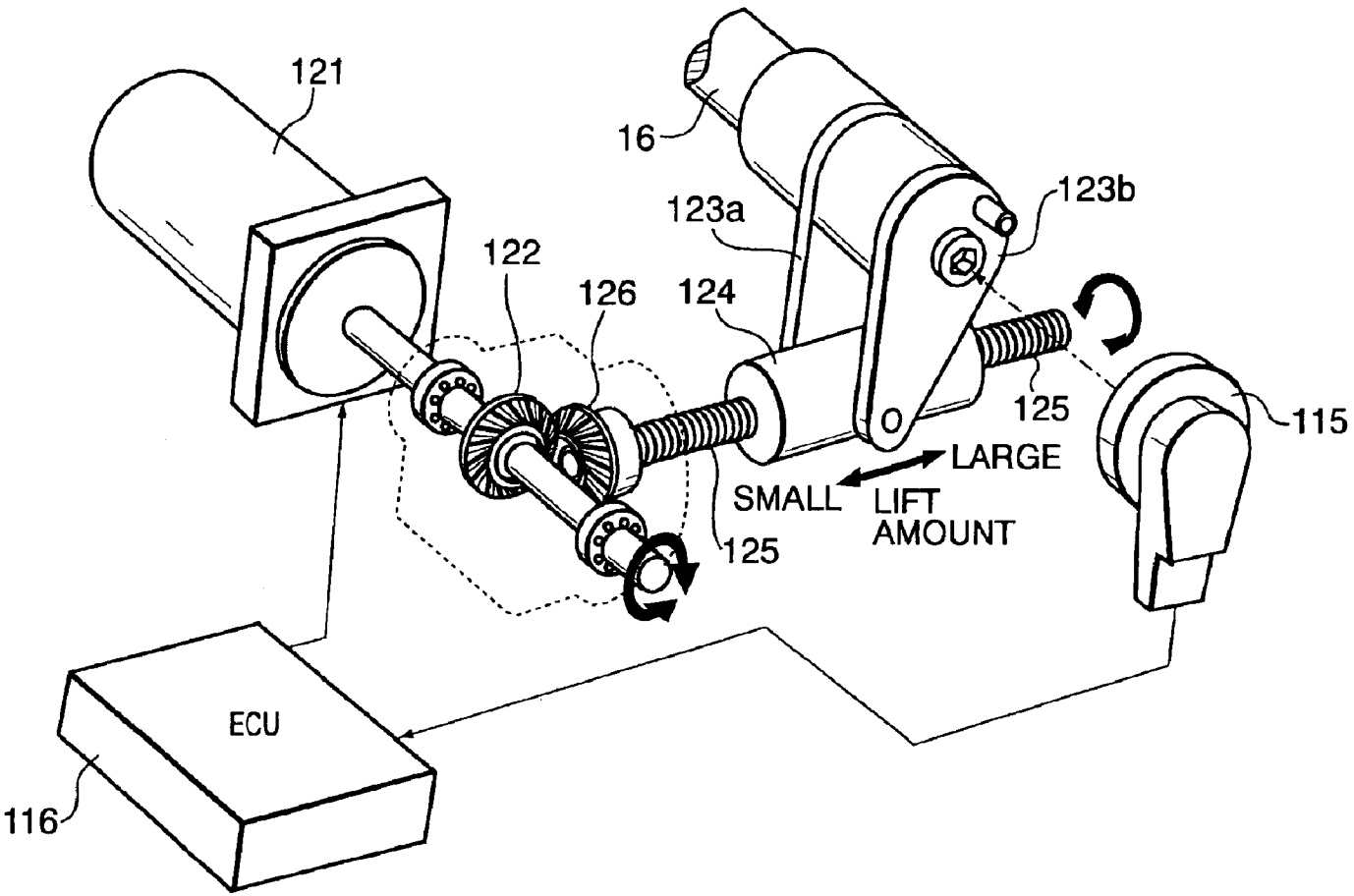
FIG. 10 is a perspective view showing a rotation driving mechanism of a control shaft in the variable valve characteristic mechanism.

FIG. 10 shows a driving mechanism of control shaft 16 (a pair of driving mechanisms is provided on the left and right banks). Namely, control shaft 16 is driven to rotate within a predetermined rotation angle range by a DC servo motor (actuator) 121. By varying an angle of control shaft 16 by actuator 121, the valve lift amount and valve operating angle of each of intake valves 105, 105 are successively varied (refer to FIG. 9).

In FIG. 10, DC servo motor 121 is arranged so that the rotation shaft thereof is parallel with control shaft 16, and a bevel gear 122 is axially supported by the tip portion of the rotation shaft.

On the other hand, a pair of stays 123*a*, 123*b* are fixed to the tip portion of control shaft 16. A nut 124 is swingingly supported around an axis parallel to control shaft 16 connecting the tip portions of the pair of stays 123*a*, 123*b*.

A bevel gear 126 meshed with bevel gear 122 is axially supported at the tip portion of a threaded rod 125 engaged with nut 124. Threaded rod 125 is rotated by the rotation of DC servo motor 121, and the position of nut 124 engaged with threaded rod 125 is displaced in the axial direction of threaded rod 125, so that control shaft 16 is rotated.

In this embodiment, the valve lift amount is decreased as the position of nut 124 approaches bevel gear 126, while the valve lift amount is increased as the position of nut 124 gets away from bevel gear 126.

Further, operating angle sensor 115 detecting the valve operating angle by detecting a rotation angle of control shaft 16 is disposed on the tip end of control shaft 16. ECU 116 feedback controls DC servo motor 121 so that an actual rotation angle detected by operating angle sensor 115 coincides with a target rotation angle. Here, since the valve lift amount and the valve operating angle can be varied simultaneously by the control of the rotation angle of control shaft 16, operating angle sensor 115 detects the valve lift amount simultaneously with the valve operating angle.

Control shaft 16 is driven to rotate within the predetermined rotation angle range by actuator 121, such as DC servo motor, disposed to one end portion thereof, and by varying the operating angle of control shaft 16 by actuator 121, the valve lift amount and the valve operating angle of each of intake valves 107, 107 are successively varied, so that the valve operating angle is changed to be smaller in accordance with a decrease of valve lift amount (refer to FIG. 9).

In the case where the valve lift amount and the valve operating angle are made to be smaller, as shown in (A) and (B) of FIG. 6, control shaft 16 is rotated so that the center axis P2 of control shaft 16 is positioned below the center axis P1 of control cam 17, whereas in the case where the valve lift amount and the valve operating angle are made to be larger, as shown in (A) and (B) of FIG. 7, the control shaft 16 is rotated so that the center axis P2 of control shaft 16 is positioned above the center axis P1 of control cam 17.

Control unit 116 converts an output (output voltage) from operating angle sensor 115 into the operating angle of control shaft 16 in accordance with a previously set conversion characteristic, and feedback controls actuator 121 so that the detection result of operating angle coincides with a target value.

Next, the description will be made on a fail-safe control at the time of failure according to the present invention, in V-type internal combustion engine 101 equipped with two WEL mechanisms 114L and 114R on each bank (cylinder group).

To be specific, an occurrence of failure in WEL mechanisms 114L and 114R is diagnosed, and if one of WEL mechanisms is failed, the fail-safe control is performed such that an intake air amount control is compensated by the other WEL mechanism.

Figure 11:
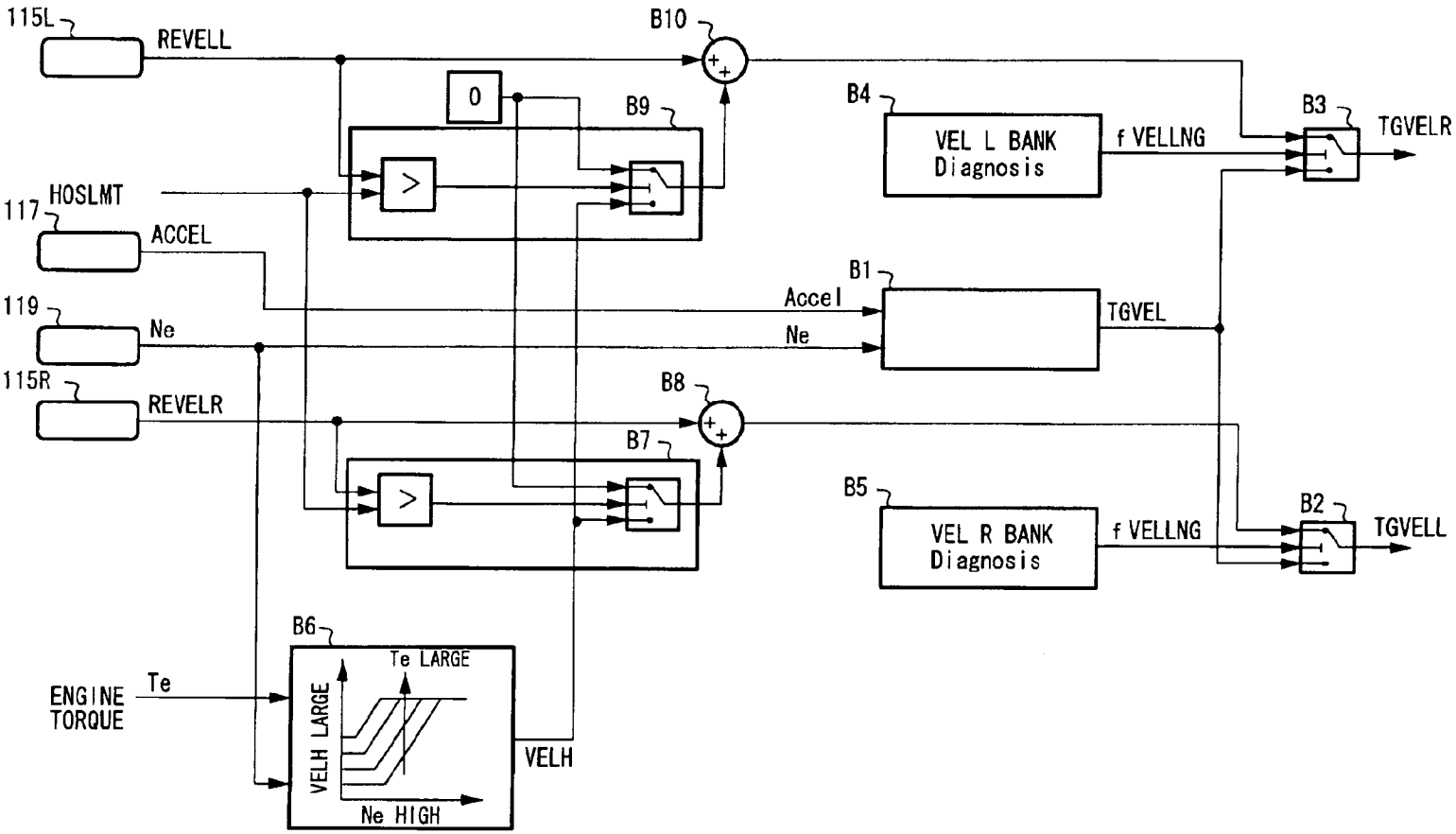
FIG. 11 is a block diagram showing a fail-safe control performed in the above embodiment.

Such a fail-safe control will be described referring to a block diagram in FIG. 11.

In a basic control value calculation block B1 (referred to as B1 in the figure, and the same rule is applied to subsequent blocks), a target engine torque Te is calculated based on an accelerator opening ACC detected by accelerator pedal sensor APS 117 and an engine rotation speed Ne detected by crank angle sensor 119, to set target controlled variable of WEL 114 corresponding to the target engine torque Te, that is, a basic target operating angle TGVEL0 of control shaft 16.

This basic target operating angle TGVEL0 is output to a left bank control value switching block B2 and a right bank control value switching block B3, respectively.

In a left bank failure diagnosis block B4, an occurrence of failure in left bank WEL mechanism 114L is diagnosed, and in a right bank failure diagnosis block B5, an occurrence of failure in right bank WEL mechanism 114R is diagnosed. To be specific, an occurrence of failure is diagnosed, when a state where a difference between the target operating angle and the actual operating angle of the corresponding WEL mechanism is large, has continued for a predetermined period of time, when an excess current equivalent to that at the locked time of DC servo motor being actuator, flows continuously for a predetermined period of time, when a state where a control indicated value (duty value or the like) is fixed maximum or minimum (100%, 0% or the like) has continued for a predetermined period of time or above, or the like. Then, the diagnosis result of the left bank failure diagnosis block B4 is output to the right bank control value switching block B3, as a control value switching signal, and the diagnosis result of the right bank failure diagnosis block B5 is output to the left bank control value switching block B2, as a control value switching signal.

A compensation operating angle calculation block B6 receives the target engine torque Te and the engine rotation speed Ne, and calculates, based on them, a compensation operating angle VELH equivalent to the compensation torque, in order to ensure the torque required for the case of the lack of torque, when the WEL mechanism on one of the banks is failed and also the actual operating angle (actual lift amount) in such a failed state is less than a predetermined value, and the normal WEL on the other bank is controlled in conformity with the actual operating angle in the failed state. To be specific, in a low rotation and low torque region, since a resistance in passing through the intake valve is small even if the operating angle is small, to easily ensure a required intake air amount, the compensation torque is small. However, in a high rotation and high torque region, since the resistance in passing through the intake valve is increased if the operating angle is small, and the required intake air amount cannot be ensured, the compensation torque VELH is set to be large.

In a left bank compensation judgment block B7, it is judged whether or not an actual operating angle (actual lift amount) REVELR at the failed time of right bank WEL mechanism 114R, which is detected by operating angle sensor 115R, is equal to or larger than a predetermined value HOSLMIT. If the actual operating angle (actual lift amount) REVELR is equal to or larger than the predetermined value HOSLMIT, an output from the left bank compensation judgment block B7 is stopped. On the other hand, if the actual operating angle (actual lift amount) REVELR is less than the predetermined value HOSLMIT, the compensation operating angle VELH calculated by the compensation operating angle calculation block B6 is output to a left bank addition block B8.

Similarly, in a right bank compensation judgment block B9, it is judged whether or not an actual operating angle (actual lift amount) REVELL at the failed time of left bank WEL mechanism 114L, which is detected by operating angle sensor 115L, is equal to or larger than the predetermined value HOSLMIT. If the actual operating angle (actual lift amount) REVELL is equal to or larger than the predetermined value HOSLMIT, an output from the right bank compensation judgment block B9 is stopped. On the other hand, if the actual operating angle (actual lift amount) REVELL is less than the predetermined value HOSLMIT, the compensation operating angle VELH is output to a right bank addition block B10.

Here, the configuration may be such that, since the valve characteristic leading the lack of torque, is varied according to the engine operating conditions, the predetermined value HOSLMIT is variably set according to the engine operating conditions, thereby enabling the control coping with the lack of required torque according to the engine operating conditions.

In the left bank addition block B8, the compensation operating angle output from the left bank torque compensation judgment block B7 is added to the actual operating angle REVELR at the failed time of right bank WEL mechanism 114R, and the result of addition is output to the left bank control value switching block B2, as a left bank fail-safe control value VELLFS.

Similarly, in the right bank addition block B10, the compensation operating angle output from the right bank torque compensation judgment block B9 is added to the actual operating angle REVELL at the failed time of left bank WEL mechanism 114L, and the result of addition is output to the right bank control value switching block B3, as a right bank fail-safe control value VELRFS.

An overall operation by the functions of the above respective blocks will be described.

When it is judged by the left bank failure diagnosis block B4 and the right bank failure diagnosis block B5 that both left and right bank WEL mechanisms 114L and 114R are normally operating, the right bank control value switching block B3 and the left bank control value switching block B2 respectively on opposite bank sides switchingly control, based on the diagnosis results, the basic target operating angle TGVEL0 calculated by the basic control value calculating block B1, so as to be output as the target operating angles TGVELL and TGVELR of left and right WEL mechanisms 114L and 114R.

Further, for example when it is judged by the left bank failure diagnosis block B4 that left bank WEL mechanism 114L is failed, the right bank control value switching block B3 outputs the right bank fail-safe control value VELRFS received from the right bank addition block B10, as the target operating angle TGVELR of right bank WEL mechanism 114R.

Here, when the actual operating angle (actual lift amount) REVELL of WEL mechanism 114L in the failed state is a predetermined value or above, since the right bank fail-safe control value VELRFS is set to be equal to the actual operating angle REVELL, there is performed the control to coincide the operating angle of right bank WEL mechanism 114R with the operating angle of left bank WEL mechanism 114L in the failed state. Thus, since the valve characteristics of left and right WEL mechanisms 114L and 114R equal to each other, it is possible to perform a fail-safe control which prevents a torque difference.

On the other hand, when the actual operating angle REVELL of WEL mechanism 114L in the failed state is less than the predetermined value, the right bank fail-safe control value VELRFS is set to the operating angle obtained by adding the compensation operating angle VELH to the actual operating angle REVELL, and normal right bank WEL mechanism 114R is controlled to have the operating angle (lift amount) larger than that of left bank WEL mechanism 114L in the failed state. Thus, in the case where the operating angle is small in the failed state, and the lack of torque occurs if the control coping with this operating angle is performed, the right bank fail-safe control value VELRFS is set to the operating angle which is increased by the compensation operating angle VELH equivalent to the compensation torque, thereby enabling the fail-safe control which prevents the lack of torque.

Similarly, when it is judged by the right bank failure diagnosis block B5 that right bank WEL mechanism 114R is failed, the left bank fail-safe control value VELLFS is output as the target operating angle TGVELL of left bank WEL mechanism 114L. Then, when the actual operating angle REVELR of failed right bank WEL mechanism 114R is a predetermined value or above, the left bank fail-safe control value VELLFS equals to the actual operating angle REVELR, thereby enabling the fail-safe control to make the operating angles of left and right WEL mechanisms 114L and 114R to be the operating angle REVELR in the failed state, which prevents the torque difference. On the other hand, when the actual operating angle REVELR is less than the predetermined value, the left bank fail-safe control value VELLFS is controlled to the operating angle larger by the compensation operating angle VELH than the actual operating angle REVELR, thereby enabling the fail-safe control which prevents the lack of torque.

As described above, in the case where the effective opening degree in the valve characteristic in the failed state is a predetermined value or above, and therefore, there does not occur the lack of torque if the valve characteristic of the normal side is coincident with the valve characteristic in the failed state, the control to coincide the valve characteristic of the normal side with the valve characteristic in the failed state is performed, to completely avoid the torque difference. On the other hand, in the case where the effective opening degree in the valve characteristic in the failed state is less than the predetermined value, and therefore, there occurs the lack of torque if the valve characteristic of the normal side is coincident with the valve characteristic in the failed state, there is performed a control for limiting the control to coincide the valve characteristic of the normal side with the valve characteristic in the failed state, thereby enabling the lack of torque to be avoided.

Especially, in the present embodiment, the control for limiting the control to coincide the valve characteristic of the normal side with the valve characteristic in the failed state, is performed based on the engine operating conditions, particularly, the target engine torque and the engine rotation speed. Therefore, it is possible to control appropriately an increase amount of the effective opening degree according to the lack of required torque, which is different depending on the engine operating conditions, thereby enabling the reduction of the torque difference due to the increase of the effective opening degree. Further, it is possible to achieve the valve characteristic in which an increase amount of the effective opening degree is set more appropriately, based on the target engine torque and the engine rotation speed.

Moreover, the configuration may be such that, based on the engine operating conditions (accelerator opening, engine rotation speed and the like), the valve characteristic in the failed state (threshold of the effective opening degree) for switching between the time when performing the control to coincide the valve characteristic of the normal side with the valve characteristic of the failed side and the time when performing the control for limiting the control to coincide the valve characteristic of the normal side with the valve characteristic of the failed side, is variably set, and the necessity of limitation is switched while comparing the valve characteristic variably set for each operating region with the valve characteristic in the actually failed state. For example, the limitation is made at less than the effective opening degree minimally set, in the low speed and low torque region.

If the configuration is such that the valve characteristic for when the limitation is made, is obtained by adding the compensation operating angle according to the compensation torque to the operating angle in the failed state, based on the engine operating conditions (target engine torque, the engine rotation speed and the like) as in the above embodiment, the control of higher accuracy can be performed. However, for the simplicity, the configuration may be such that the valve characteristic is controlled to the basic target operating angle TGVEL0 set only by the engine operating conditions.

Further, the present invention achieves a large effect by being applied to the WEL mechanisms for the intake valves. However, the present invention can be effectively applied to an internal combustion engine in which the valve characteristic of exhaust valve is variably controlled by the WEL mechanism for each of a plurality of cylinder groups. This is because, in the case where the WEL mechanism is failed, and the valve characteristic of exhaust valve is fixed, although the torque difference can be avoided if the valve characteristic of the normal WEL mechanism is coincident with the valve characteristic of the failed WEL mechanism, there is a possibility of lack of torque (if the lift amount is small, there may occur the lack of torque due to an increase of exhaust resistance).

It is surely possible to apply the present invention to an internal combustion engine equipped with WEL mechanisms capable of varying valve characteristics relating to an effective opening degree of a valve for each of a plurality of cylinder groups, other than the V-type internal combustion engine.

The entire contents of Japanese Patent Application No. 2003-179478 filed Jun. 24, 2003, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention are provided for illustration only, and not for the purpose of limiting the invention as defined by the appended claims and their equivalents.

What is claimed is:

1. A fail-safe control apparatus for an internal combustion engine, comprising:

a variable valve characteristic mechanism disposed for each of a plurality of cylinder groups, that varies a valve characteristic relating to an effective opening degree of an engine valve;

a valve characteristic detector detecting the valve characteristic of said engine valve; and a control unit that controls said variable valve characteristic mechanism based on a detection result of said valve characteristic, wherein said control unit:

detects a failed state of the variable valve characteristic mechanism for each cylinder group;

when it is judged that the variable valve characteristic mechanism of any one of cylinder groups is failed, if the effective opening degree in the valve characteristic in said failed state detected by said valve characteristic detector is a predetermined value or above, controls the valve characteristic of the normal variable valve characteristic mechanism of the other cylinder group to be coincident with the valve characteristic of the failed variable valve characteristic mechanism; and if the effective opening degree is less than the predetermined value, performs a control for limiting the control to coincide the valve characteristic of said normal variable valve characteristic mechanism with the valve characteristic of said failed variable valve characteristic mechanism.

2. A fail-safe control apparatus for an internal combustion engine according to claim 1, wherein said control unit;

if the effective opening degree in the valve characteristic in said failed state is less than the predetermined value, controls said normal variable valve characteristic mechanism to have a valve characteristic in which the effective opening degree is set to be larger than that in the valve characteristic of the failed variable valve characteristic mechanism, based on engine operating conditions.

3. A fail-safe control apparatus for an internal combustion engine according to claim 2, wherein said control unit;

if the effective opening degree in the valve characteristic in said failed state is less than the predetermined value, sets the valve characteristic of said normal variable valve characteristic mechanism based on the target engine torque and an engine rotation speed.

4. A fail-safe control apparatus for an internal combustion engine according to claim 1, wherein said control unit;

sets variably said predetermined value to be compared with the effective opening degree in the valve characteristic in the failed state according to engine operating conditions.

5. A fail-safe control apparatus for an internal combustion engine according to claim 1, wherein said control unit;

when a state where a difference between a target valve characteristic and an actual valve characteristic of the variable valve characteristic mechanism is large, has continued for a predetermined period of time or more, detects an occurrence of failure in said variable valve characteristic mechanism.

6. A fail-safe control apparatus for an internal combustion engine according to claim 1, wherein said control unit;

when a predetermined period of time has continued after a supply current value of an electric actuator driving the variable valve characteristic mechanism becomes an excess current value in a locked state of said actuator, detects an occurrence of failure in said variable valve characteristic mechanism.

7. A fail-safe control apparatus for an internal combustion engine according to claim 1, wherein said control unit;

when a predetermined period of time has continued in a state where a control indicated value for the variable valve characteristic mechanism is fixed maximum or minimum, detects an occurrence of failure in said variable valve characteristic mechanism.

8. A fail-safe control apparatus for an internal combustion engine according to claim 1, wherein said variable valve characteristic mechanism varies at least one of a valve lift amount or a valve operating angle (a crank angle of from opening to closing of the engine valve) of the engine valve.

9. A fail-safe control apparatus for an internal combustion engine according to claim 8, wherein said variable valve characteristic mechanism continuously varies the valve lift amount and the valve operating angle of the engine valve.

10. A fail-safe control apparatus for an internal combustion engine according to claim 9, wherein said variable valve characteristic mechanism comprises:

a drive shaft rotating in synchronism with a crankshaft;

a drive cam fixed to said drive shaft;

a swing cam swinging to operate said valve to open and close;

a transmission mechanism with one end connected to said drive cam side and the other end connected to said swing cam side;

a control shaft having a control cam changing the position of said transmission mechanism; and an actuator rotating said control shaft, and continuously varies the valve lift amount together with the valve operating angle of the engine valve by rotatably controlling said control shaft by said actuator.

11. A fail-safe control apparatus for an internal combustion engine according to claim 1, said variable valve characteristic mechanism varies a valve characteristic of at least an intake valve, in the engine valve comprising said intake valve and an exhaust valve.

12. A fail-safe control apparatus for an internal combustion engine, comprising:

a variable valve characteristic mechanism disposed for each of a plurality of cylinder groups, that varies a valve characteristic relating to an effective opening degree of an engine valve;

valve characteristic detection means for detecting the valve characteristic of said engine valve;

failure detecting means for detecting a failed state of the variable valve characteristic mechanism for each cylinder group;

effective opening degree judging means for judging, when it is judged that the variable valve characteristic mechanism of any one of cylinder groups is failed, whether or not the effective opening degree in the valve characteristic in said failed state detected by said valve characteristic detecting means is a predetermined value or above; and fail-safe control means for controlling the valve characteristic of the normal variable valve characteristic mechanism of the other cylinder group to be coincident with the valve characteristic of the failed variable valve characteristic mechanism, when it is judged by said effective opening degree judging means that the effective opening degree is the predetermined value or above, and for performing a control for limiting the control to coincide the valve characteristic of said normal variable valve characteristic mechanism with the valve characteristic of said failed variable valve characteristic mechanism, when the effective opening degree is less than the predetermined value.

13. A fail-safe control method for an internal combustion engine equipped with a variable valve characteristic mechanism that varies a valve characteristic relating to an effective opening degree of an engine valve, for each of a plurality of cylinder groups, comprising the steps of:

detecting the valve characteristic of said engine valve;

detecting a failed state of the variable valve characteristic mechanism for each cylinder group;

judging, when it is judged that the variable valve characteristic mechanism of any one of cylinder groups is failed, whether or not the effective opening degree in the valve characteristic in said detected failed state is a predetermined value or above;

controlling the valve characteristic of the normal variable valve characteristic mechanism of the other cylinder group to be coincident with the valve characteristic of the failed variable valve characteristic mechanism, when it is judged that the effective opening degree is the predetermined value or above; and performing a control for limiting the control to coincide the valve characteristic of said normal variable valve characteristic mechanism with the valve characteristic of said failed variable valve characteristic mechanism, when the effective opening degree is less than the predetermined value.

14. A fail-safe control method for an internal combustion engine according to claim 13, wherein said step of performing the control for limiting the control to coincide the valve characteristic of said normal variable valve characteristic mechanism with the valve characteristic of said failed variable valve characteristic mechanism, when the effective opening degree is less than the predetermined value;

controls said normal variable valve characteristic mechanism to have a valve characteristic in which the effective opening degree is set to be larger than that in the valve characteristic of the failed variable valve characteristic mechanism, based on engine operating conditions.

15. A fail-safe control method for an internal combustion engine according to claim 13, wherein, when the effective opening degree in the valve characteristic in said failed state is less than the predetermined value, the valve characteristic of said normal variable valve characteristic mechanism is set based on the target engine torque and an engine rotation speed.

16. A fail-safe control method for an internal combustion engine according to claim 13, further comprising the step of;

setting variably the predetermined value to be compared with the effective opening degree in the valve characteristic in said failed state according to engine operating conditions.

17. A fail-safe control method for an internal combustion engine according to claim 13, wherein said step of detecting the failed state of the variable valve characteristic mechanism;

when a state where a difference between a target valve characteristic and an actual valve characteristic of the variable valve characteristic mechanism is large, has continued for a predetermined period of time or more, detects an occurrence of failure in said variable valve characteristic mechanism.

18. A fail-safe control method for an internal combustion engine according to claim 13, wherein said step of detecting the failed state of the variable valve characteristic mechanism;

when a predetermined period of time has continued after a supply current value of an electric actuator driving the variable valve characteristic mechanism becomes an excess current value in a locked state of said actuator, detects an occurrence of failure in said variable valve characteristic mechanism.

19. A fail-safe control method for an internal combustion engine according to claim 13, wherein said step of detecting the failed state of the variable valve characteristic mechanism;

when a predetermined period of time has continued in a state where a control indicated value for the variable valve characteristic mechanism is fixed maximum or minimum, detects an occurrence of failure in said variable valve characteristic mechanism.

* * * * *